United States Patent [19]

Teague

[11] 4,371,092

[45] Feb. 1, 1983

[54] WASTE CONTAINER WITH PERMANENT LID HOLD-DOWN ASSEMBLIES

[76] Inventor: Lyndon M. Teague, 1519 Chestnut St., Wilmington, N.C. 28401

[21] Appl. No.: 316,227

[22] Filed: Oct. 29, 1981

[51] Int. Cl.[3] ..... B65D 45/16

[52] U.S. Cl. ..... 220/324; 220/1 T; 220/214; 292/253

[58] Field of Search ..... 220/1 T, 214, 324; 292/253, 307 R

[56] References Cited

U.S. PATENT DOCUMENTS 2,918,319 12/1959 Richardson ..... 292/253

3,991,902 11/1976 Ford, Jr. ..... 220/324

4,331,257 5/1982 Taschner ..... 220/324

FOREIGN PATENT DOCUMENTS 398331 9/1933 United Kingdom ..... 292/253

*Primary Examiner*—George T. Hall

[57] ABSTRACT

A rectangularly shaped metallic container and sealed lid with permanent lid hold-down assemblies for use in disposal of low specific activity, minimally contaminated waste material. The hold-down assemblies give visual indications of the sealed condition of the container as they can only be removed or opened by total destruction after placed in holding position.

7 Claims, 4 Drawing Figures

WASTE CONTAINER WITH PERMANENT LID HOLD-DOWN ASSEMBLIES

SUMMARY OF THE INVENTION

The object of this invention is to provide an economical non-reusable container for solid waste which, unlike existing cylindrical containers, maximizes the volume/-cubic spaces displacement ratio, thus providing additional advantages in storage, transportation and capacity.

The sealed waste containers of this invention is substantially rectangular in shape and consists of four sides, a bottom wall and a closure in the form of a lid or cover. The edges of the lid as well as the exposed edges of the sides are reinforced so as to provide rigid contacting surfaces.

Lid hold-down assemblies are employed to permanently seal and close the container and include a series of stirrups fixedly attached to the outer wall surfaces of the sides adjacent their exposed top edges. There is provided a permanent locking member for each stirrup. These locking members consist of an angled metal piece having a long leg adapted to be projected into a corresponding stirrup and a short flange normally extending at an acute angle to the long leg. The short flange is adapted to engage the reinforced edge of the lid and when the locking member is in its positive locking position such flange will have been biased into full facial abutment with the reinforced edge of the lid at which time it will be disposed at 90 degrees to the long leg.

The long leg of the locking member provides on its outer surface a retaining element which is adapted to be forcefully projected beneath the bottom edge of the stirrup when the locking member has been placed in its positive locking position.

When all of the hold-down assemblies have been placed in positive locking position, the container lid can only be removed by complete destruction of the locking member and/or its cooperating stirrup. The destruction of either element will give ready visual indication that the lid is not in a sealed locked condition. This is highly advantageous naturally from a security standpoint as such visual check will assure that the container and/or lid has not been tampered with after it has been placed in a positive locked position.

DESCRIPTION OF THE DRAWINGS

The invention will best be understood by reference to the accompanying drawing which shows the preferred form of embodiment of the invention by which the stated objects thereof are achieved, and in which.

GENERAL DESCRIPTION OF THE INVENTION

Figure 1:
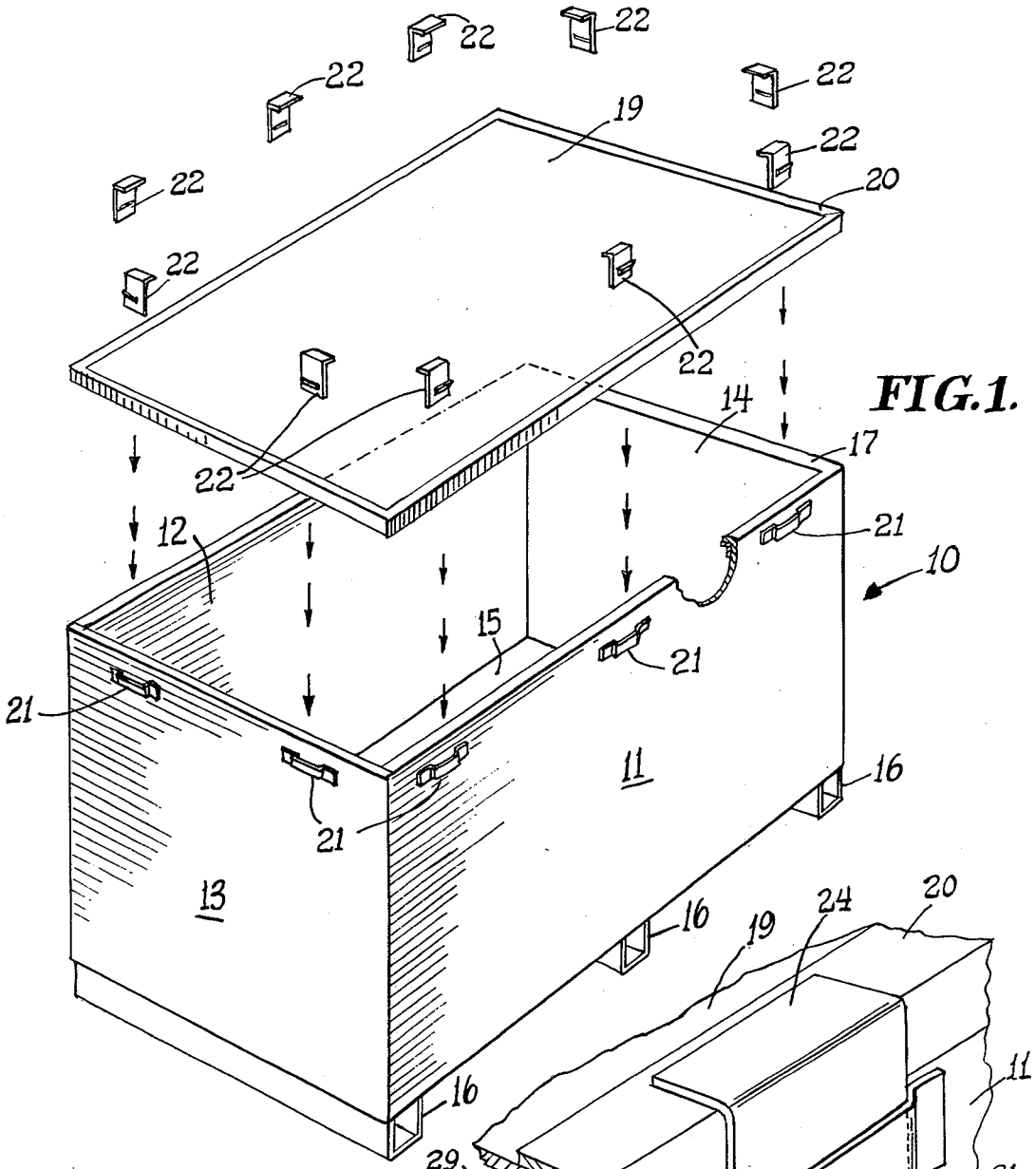
FIG. 1 is a perspective view of the container lid and locking members in an exploded relationship.

As illustrated in FIG. 1, the waste container 10 of this invention consists of a metallic box-like structure having a front wall 11, a back wall 12, and side walls 13 and 14. A full bottom wall 15 connects all of the walls together and, in turn, is supported by a number of standoff pads 16 to facilitate handling of the container with a fork-lift.

The top edges of the walls provide inwardly directed flanges 17, which are reinforced by a metallic angle-iron 18 which is so positioned as to underlie the interior edge of the walls about the periphery of its opened top.

A metallic lid or cover 19 is provided and it has its peripheral edges reinforced by an overlying angle-iron 20. The size of the lid, together with its reinforced edges, overlie the area defined by the reinforced edges 17 of the walls of the container.

Spaced about the periphery of the container and attached to the outer wall surfaces of the walls thereof are a plurality of metallic stirrups 21.

Figure 4:
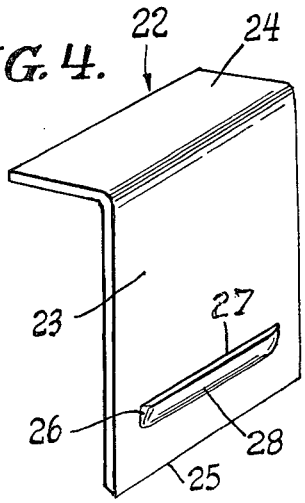
FIG. 4 is a perspective view of the locking member of FIG. 3.
Figure 3:
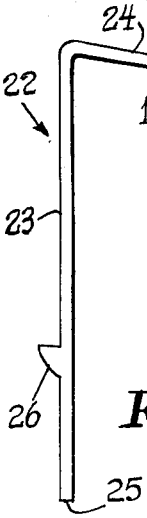
FIG. 3 is a side elevational view of the locking member embodied in this invention.

For each stirrup 21 there is provided a locking member 22. As shown in FIGS. 3 and 4, this locking member 22 consists of an angled iron element that provides a long leg 23 which terminates at its upper edge into a flange 24. In its normal state the flange 24 is acutely angled with respect to the long leg 23, this for a purpose hereinafter made apparent.

On the outer surface of the long leg 23 adjacent the bottom edge 25 is a retaining strip 26. As clearly shown, this retaining strip 26 provides a shoulder 27 which extends at right angles to the normal plane of the long leg 23 of the locking member 22. The outer surface of the retaining member 26 is curved so as to provide a camming surface 28.

Figure 2:
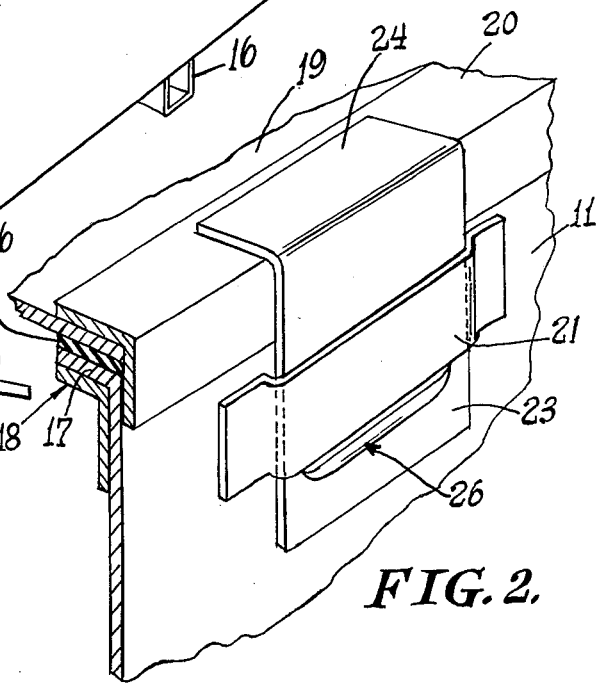
FIG. 2 is a fragmentary perspective view of the lid and locking member in a positive locked position.

It should be noted that as shown in FIG. 2 the periphery edge of the cover 19 is provided with a sealing gasket 29 which will bear upon the reinforced edge 17 of the walls of the container 10 when the lid is placed thereon.

With the lid 19 placed on the container 10 a locking member 22 will have its long leg 23 projected into a corresponding stirrup 21, with the retaining member 26 preventing further insertion of the locking member 22 into the stirrup 21. At this point, the angle flange 24 will be in a slight spaced relation to the reinforced edge 20 of the lid 19.

As each locking member, particularly the flange 24, is struck a blow by a heavy object such as a hammer or the like, the retaining strip 26 with the cooperation of the camming surface 28 thereof will be forced through the stirrup 21 until the shoulder 27 engages the lowermost edge of the stirrup 21 as shown in FIG. 2. At the same time, the acute angled flange 24 will be forced into full facial abutment with the reinforced edge 20 of the lid 19 and against its normal angular displacement be positioned under pressure into a substantial right angle with respect to the long leg 23. In this position, the entire inner surface of both the long leg 23 and angled flange 24 will be in facial abutment with corresponding surfaces of the lid and container.

When all of the locking members have been forcefully placed in a locking position the lid is permanently sealed and locked onto the container 10. The only way in which the lid can be opened is by total destruction of either the holding stirrups 21 or the locking members 22. Such destruction will give a ready visual indicator that the lid has been tampered with or is in need of replacement.

When the locking members 22 are in their locking position, as shown in FIG. 2, the sealing gasket 29 will be compressed into a permanent retained sealing position.

While the retaining strip 26 has been shown and described as being located on the outer surface of the long leg 23 of the locking member 22, it may be located at the bottom edge thereof. It could also be an angled continuation of the long leg 23, which in turn, would then form a locking flange extending in opposite parallel directions with respect to the flange 24. These and other variations come within the concept of this invention.

The rectangular shape of the container 10 is unique to the degree in that its dimensions will accommodate the same cubic capacity of standard barrels presently used for the disposal of waste material. This shape of the container thus readily reduces material handling and will afford the acceptance of various sizes and shapes of disposal material that could not be accommodated in the limited diameter of barrels, thus rendering a cost savings in that a fewer number of containers of this invention need be transported to disposal sites, saving large sums of money in trucking and handling costs.

From the foregoing it is apparent that I have provided a waste container with permanent lid hold-down assemblies that will achieve all of the stated objectives of the invention.

While I have illustrated and described the preferred form of construction for carrying out the invention, this is capable of variation and modification without departing from the spirit of the invention. I therefore do not wish to be limited to various details but desire to avail myself of such variations and modifications as come within the scope of the appended claims.

Having thus described my invention, what I claim as new and desire to protect by Letters Patent is:

1. A waste disposal container comprising (a) a metallic rectangularly spaced body having a bottom wall and side and end walls, (b) means for reinforcing the exposed edges of said side and end walls, (c) a metallic lid for said body, (d) means reinforcing the peripheral edge of said lid, (e) hold-down assemblies for the lid of the container including retaining members carried on the outer wall surface of said side and end walls, (f) locking members each having a portion engaging said reinforced edge of said lid and another portion in contact with said retaining means and being held thereby in facial abutment with confronting surfaces of said walls so as to secure said lid in a closing relationship on said body, (g) and means on said locking member cooperating with said retaining member for permanently securing said locking member in contact with said lid in said container for permanently securing said lid onto the container.

2. A waste disposal container as defined by claim 1 wherein said retaining means are stirrups fixedly attached to the outer wall surfaces of said walls and adapted to receive and permanently retain said lid locking members.

3. A waste disposal container as defined by claim 1 wherein said locking members comprise an angle-iron having an elongated leg portion and a flange acutely angled with respect to said leg portion, said angled flange biased into a right angle relation and into contact with said reinforced edge of said lid when said angle-iron cooperates with said retaining member to secure said lid into closing relation with said container.

4. A waste disposal container as defined by claim 3 wherein said retainer means are stirrups fixedly attached to the outer surface of said walls and adapted to receive and permanently retain said elongated leg portion of said locking members.

5. A waste disposal container as defined by claim 1 wherein said means on said locking member cooperating with said retainer member for permanently securing said members together comprises a shoulder protrusion on the face of said locking member which is adapted to be forcefully projected through and behind said retaining members when said locking members secure said lid onto said container.

6. A waste disposal container as defined by claim 5 wherein said retainer means are stirrups fixedly attached to the outer surface of said walls with said stirrups cooperating with said shoulder protrusion on said locking member for permanently connecting said locking member to said stirrup and said lid on the container.

7. A retainer assembly for securing the lid upon a waste container comprising:

a retainer bracket mounted on the exposed wall surfaces of the waste container adjacent the open top thereof, a clip member having a first portion adapted to overlie an edge of the lid to be secured upon the waste container, a second portion extending angularly from said first portion and adapted to be received within said bracket in facial abutment with the adjacent side wall of the waste container, and means interlocking between said clip and said retainer bracket for securing said clip within said retaining bracket when said lid is placed upon the open top of the waste container.

* * * * *